US008827286B2

(12) United States Patent
Woncik

(10) Patent No.: US 8,827,286 B2
(45) Date of Patent: Sep. 9, 2014

(54) FOLDING SKATEBOARD

(71) Applicant: John Woncik, Granada Hills, CA (US)

(72) Inventor: John Woncik, Granada Hills, CA (US)

(73) Assignee: John David Woncik, Granada Hills, CA (US)

( * ) Notice: Subject to any disclaimer, the term of this patent is extended or adjusted under 35 U.S.C. 154(b) by 0 days.

(21) Appl. No.: 14/166,047

(22) Filed: Jan. 28, 2014

(65) Prior Publication Data

US 2014/0138937 A1 May 22, 2014

Related U.S. Application Data

(63) Continuation-in-part of application No. 13/053,948, filed on Mar. 22, 2011, now Pat. No. 8,746,715.

(60) Provisional application No. 61/317,518, filed on Mar. 25, 2010.

(51) Int. Cl.

| | |
|---|---|
| ***B62M 1/00*** | (2010.01) |
| ***A63C 17/01*** | (2006.01) |
| ***A63C 17/00*** | (2006.01) |

(52) U.S. Cl.

CPC ..... *A63C 17/01* (2013.01); *A63C 2203/10* (2013.01); *A63C 17/012* (2013.01); *A63C 17/0093* (2013.01); *A63C 17/0006* (2013.01)

USPC ..... 280/87.042

(58) Field of Classification Search

USPC ..... 280/87.041–87.042

See application file for complete search history.

(56) References Cited

U.S. PATENT DOCUMENTS

| | | | | |
|---|---|---|---|---|
| 6,131,931 | A * | 10/2000 | Globerson et al. | 280/87.042 |
| 6,386,562 | B1 * | 5/2002 | Kuo | 280/87.042 |
| 6,616,170 | B1 * | 9/2003 | Quarti | 280/603 |
| D505,470 | S * | 5/2005 | Hong | D21/765 |
| 7,159,879 | B2 * | 1/2007 | Cole | 280/87.042 |
| 7,255,356 | B2 * | 8/2007 | Lin | 280/87.041 |
| 7,810,825 | B2 * | 10/2010 | Cole | 280/87.042 |
| D633,584 | S * | 3/2011 | Hong | D21/765 |
| 7,976,034 | B1 * | 7/2011 | Hong et al. | 280/87.042 |
| 8,201,837 | B2 * | 6/2012 | Dweek | 280/30 |
| 2002/0096849 | A1 * | 7/2002 | Bang | 280/87.041 |
| 2002/0149166 | A1 * | 10/2002 | Potter | 280/87.042 |
| 2005/0212246 | A1 * | 9/2005 | Hong | 280/87.042 |
| 2006/0049594 | A1 * | 3/2006 | Yamaguchi | 280/87.042 |
| 2006/0119062 | A1 * | 6/2006 | Lukoszek | 280/87.042 |
| 2006/0192357 | A1 * | 8/2006 | Lin | 280/87.042 |
| 2007/0029749 | A1 * | 2/2007 | Gregory et al. | 280/87.042 |
| 2007/0029750 | A1 * | 2/2007 | Gregory et al. | 280/87.042 |
| 2007/0035100 | A1 * | 2/2007 | Gregory et al. | 280/87.042 |
| 2007/0035101 | A1 * | 2/2007 | Gregory et al. | 280/87.042 |
| 2007/0182118 | A1 * | 8/2007 | Cole | 280/87.042 |
| 2009/0206572 | A1 * | 8/2009 | Cole | 280/87.042 |
| 2009/0256332 | A1 * | 10/2009 | Ekberg | 280/603 |

(Continued)

*Primary Examiner* — Jeffrey J Restifo
*Assistant Examiner* — Erez Gurari
(74) *Attorney, Agent, or Firm* — John David Woncik

(57) ABSTRACT

A folding skateboard may include a first board piece, a second board piece and a third board piece. The first board piece and third board piece may be secured to the second board piece with first and second sets of spring hinges. The folding skateboard may convert from an unfolded configuration into a folded three-layered configuration for storage. The trucks of the folding skateboard may be easily secured to and removed from the first and third board pieces.

9 Claims, 11 Drawing Sheets

(56) References Cited

U.S. PATENT DOCUMENTS

2010/0123295 A1* 5/2010 Landau ..... 280/87.042
2011/0042913 A1* 2/2011 Landau ..... 280/87.042
2011/0089656 A1* 4/2011 Chiu et al. ..... 280/87.041
2011/0236607 A1* 9/2011 Woncik ..... 428/12

* cited by examiner

FOLDING SKATEBOARD

CROSS-REFERENCE TO RELATED APPLICATIONS

The present application claims the benefit under 35 U.S.C. §119(e) of U.S. Provisional Application No. 61/317,518, filed Mar. 25, 2010, and of U.S. Non-Provisional Application No. 13/053,948, filed Mar. 22, 2011, which are incorporated herein by reference.

BACKGROUND OF THE INVENTION

The present invention is generally related to a skateboard that can be folded onto itself for easy storage and transportation when not in use.

Generally, skateboards that are between about 36" to 60" 15 long are called longboards. Longboards are intended for travel and recreational cruising, and not for rough tricks performed on standard skateboards that are 32" and under. Due to their size and length, longboards may be difficult to store or secure and many schools may not allow longboards on campus for this reason.

As can be seen there is a need for a longboard skateboard that can be folded and/or collapsed to allow for easier storage and transportation when not in use.

SUMMARY OF THE INVENTION

In one aspect of the present invention, a skateboard comprises a board deck comprising a first board piece, a second board piece, and a third board piece; a first spring hinge connecting the first board piece to the second board piece; and a second spring hinge connecting the second board piece to the third board piece, wherein, when in a folded position, the first board piece, the second board piece and the third board piece, are configured to form a hinged three-layered configuration with the second board piece disposed between the first board piece and the third board piece.

In another aspect of the present invention, a skateboard comprises a board deck comprising a first board piece, a second board piece, and a third board piece; a first spring hinge connecting the first board piece to the second board piece; a second spring hinge connecting the second board piece to the third board piece, a key slot on the first board piece; and a truck, wherein the truck is mountable to the first board piece via a fastener configured to slide into the key slot and lock the truck onto the first board piece, and, wherein, when in a folded position, the first board piece, the second board piece and the third board piece, are configured to form a hinged three-layered configuration with the second board piece disposed between the first board piece and the third board piece.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a folding skateboard.

Figure 1:
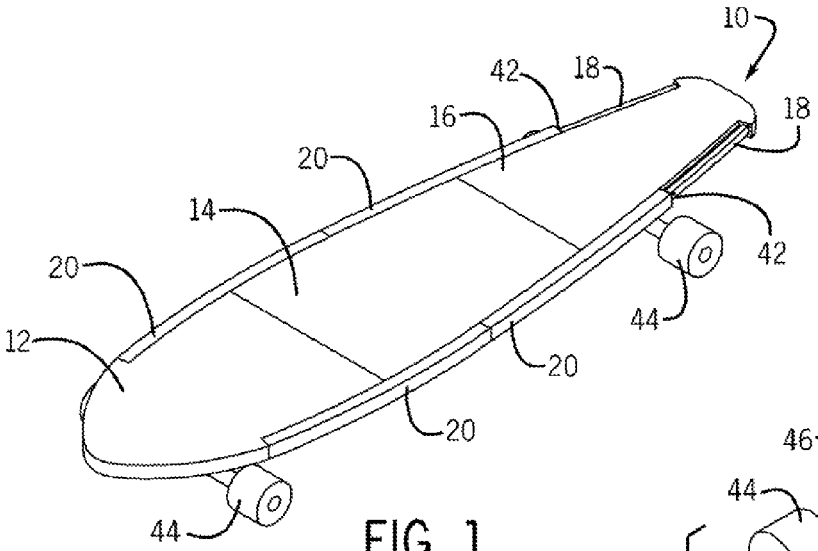
FIG. 1 illustrates a perspective view of one embodiment of an assembled folding skateboard according to the present invention.
Figure 2:
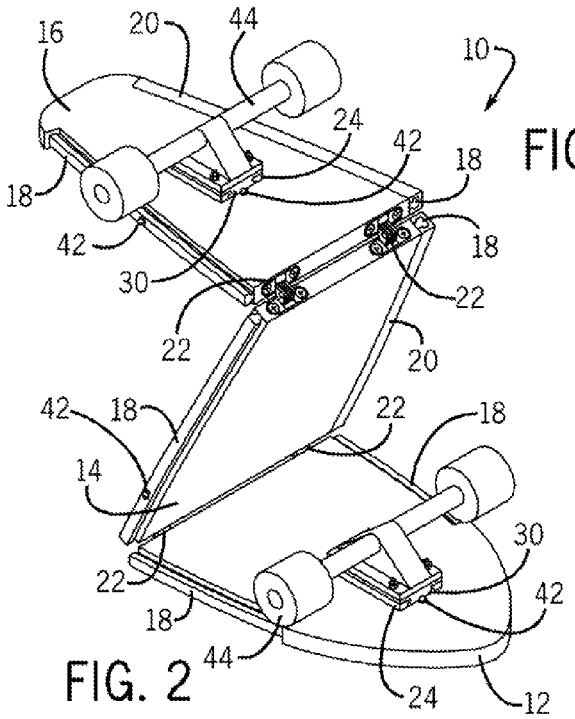
FIG. 2 illustrates a perspective view of the skateboard of FIG. 1 being folded.

FIG. 1 illustrates an exemplary embodiment of a folding skateboard 10 according to an exemplary embodiment of the present invention in an assembled state. One embodiment of the folding skateboard may be about ½" thick, about 9" wide, and about 45" long when unfolded and assembled. As illustrated in FIG. 2, the folding skateboard can fold in a hinged Z-shaped manner to form a three-layered configuration, for example, with dimensions of about 1¾" thick, about 9" wide and about 15" long.

One embodiment of the folding skateboard 10 may include a front board piece 12, a middle board piece 14 and a rear board piece 16. The front board piece 12 and rear board piece 16 may be secured to the middle board piece 14 using hinges 22 that allow the board pieces 12, 14, and 16 to sit flush against each other in an unfolded position. For example, Soss™ brand invisible hinges 22 can be used, as they are tamper-proof and cannot be seen when the longboard is unfolded flat at 9"×45". When in a folded position, the hinges 22 allow the skateboard 10 to fold into a stacked three-layer configuration. Each of the board pieces 12, 14 and 16 may be made from a sturdy material that can be about ½" thick and suitable for skateboards and/or longboards such as plywood, for example.

Figure 3:
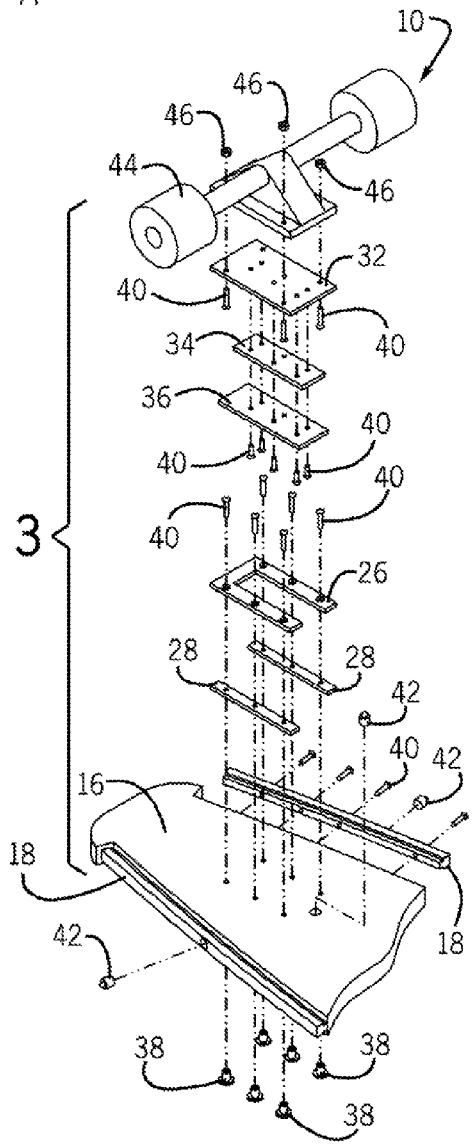
FIG. 3 is a detailed exploded perspective view illustrating one embodiment of a board and truck assembly.

One embodiment of the folding skateboard 10 may include wheels and bases, called trucks 44, that can be quickly unlocked and removed without the use of any tools. This may be achieved by using a truck shoe that can slide into a deck shoe and lock in place. FIG. 3 illustrates one embodiment of a truck shoe assembly 30 that may be premounted onto trucks 44. This embodiment of the truck shoe assembly 30 may be screwed to the trucks 44 using e.g., ⅛" aluminum plates, e.g., a 2½" by 3¼" truck shoe upper plate 32, 1" by 2½" middle plate 34, and 1¼" by 3¼" lower plate. Any brand of skateboard truck 44 can be bolted to the truck shoe's four hole upper plate 30, with counter sink screws 40 and nuts 46.

The truck shoes 30 can be male-type truck shoes that can slide and lock into female-type deck shoes 24, e.g., a 2½" by 3¼" horse-shoe shaped upper plate 26 and two ½" by 3¼" deck shoe lower plates 26 and 28, which can fasten to the board pieces 12 and 16 with, e.g., T-nut type nuts 38 and countersink screws 40.

Figure 14:
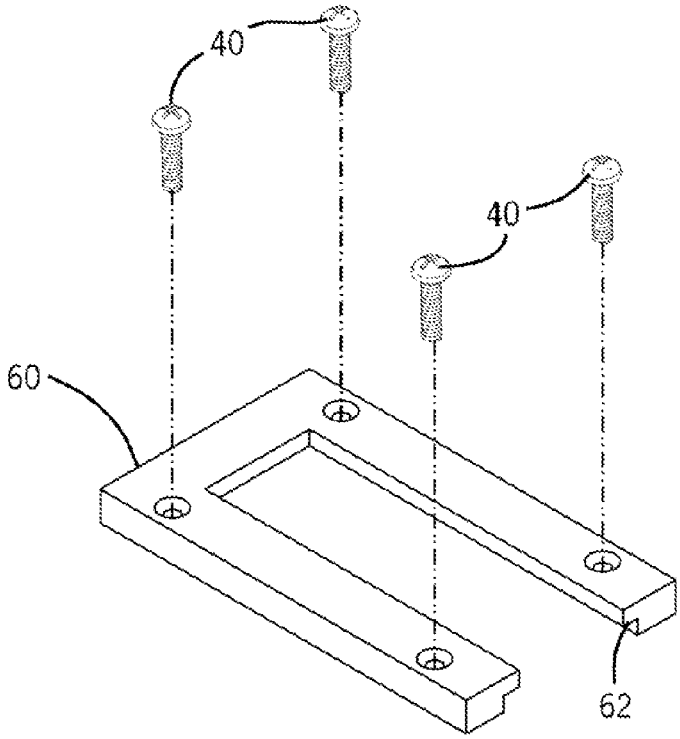
FIG. 14 illustrates an alternate embodiment of a deck shoe.
Figure 15:
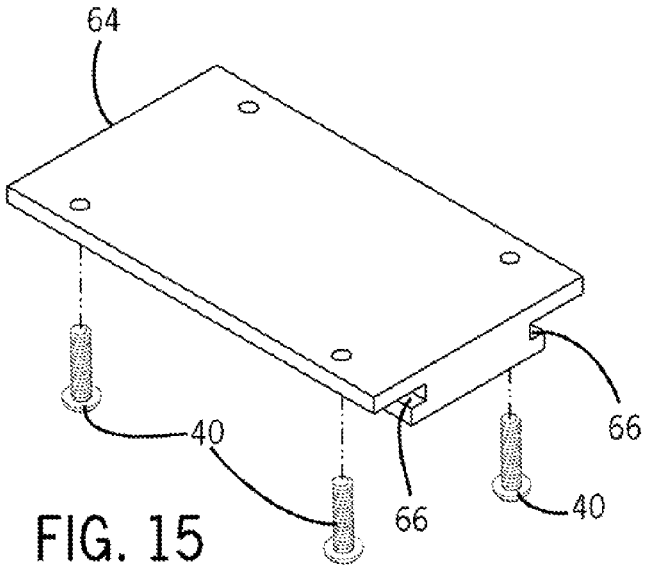
FIG. 15 illustrates an alternate embodiment of a truck shoe.
Figure 16:
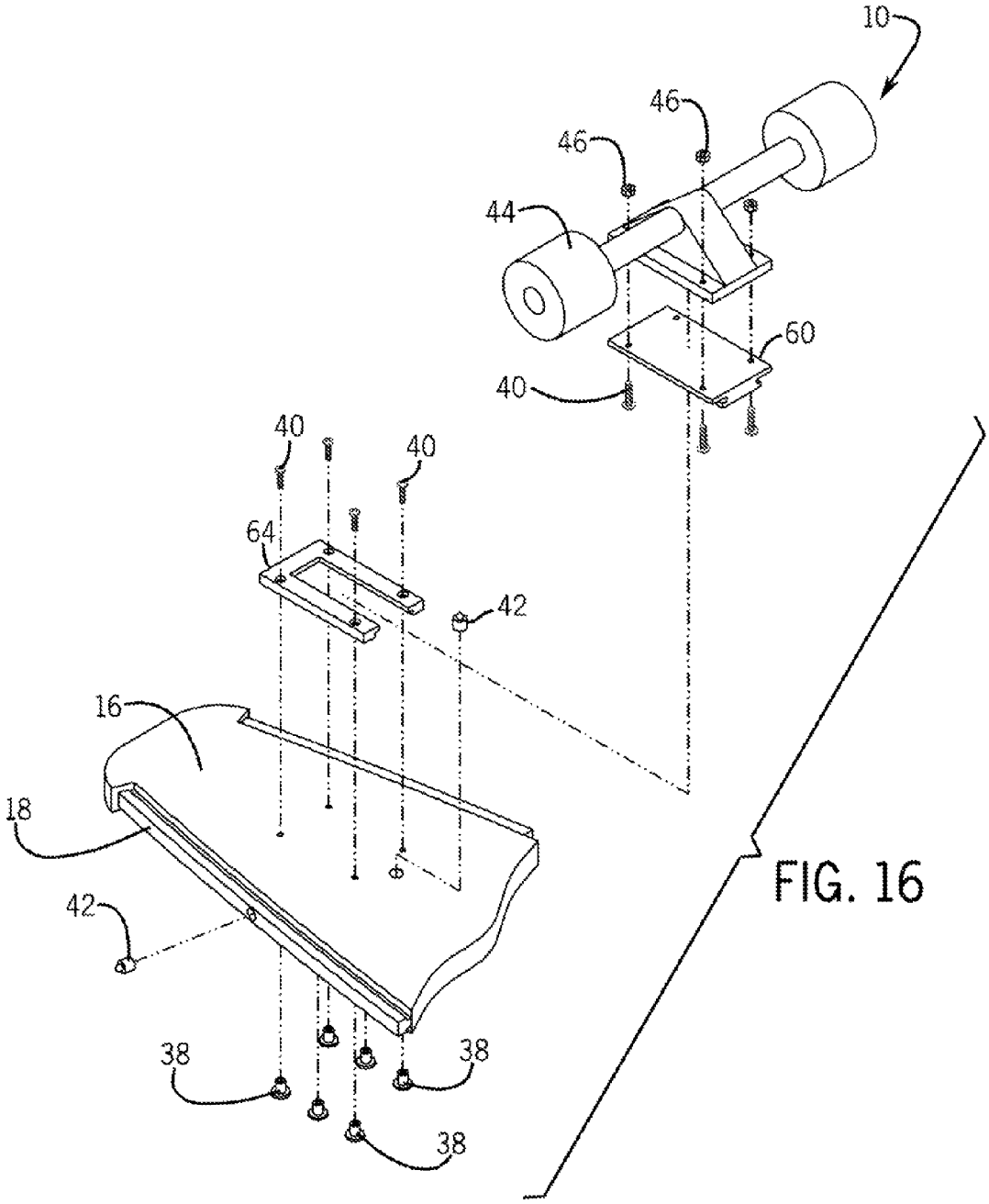
FIG. 16 is a detailed exploded perspective view illustrating another embodiment of a board and truck assembly using the truck and deck shoes of FIG. 14 and FIG. 15.

Other embodiments of the truck shoes and deck shoes may be machined using a solid piece of aluminum that may be about ⅜" thick. FIG. 14 illustrates such a deck shoe 60 having a machined relief 62 to forma female-type deck shoe 60. FIG. 15 illustrates a solid male-type truck shoe 64. As illustrated in FIG. 16, both the deck shoes 60 and truck shoes 64 may be secured to the board pieces 12 and 16 and trucks 44, respectively, using counter sink screws 40 and nuts 46 and/or T-nut type nuts 38.

Figure 7:
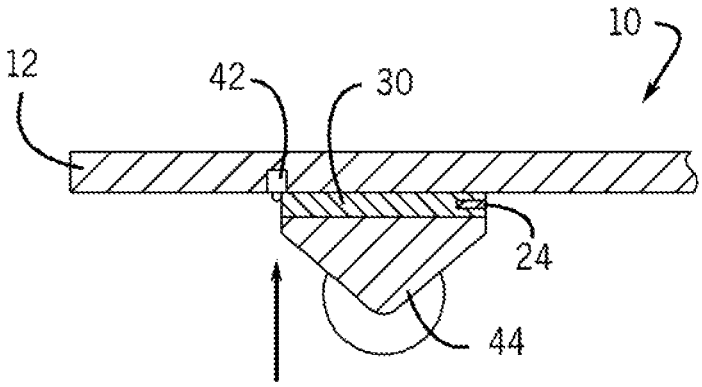
FIG. 7 is a cross-sectional view of the skateboard taken along the line 7-7 of FIG. 4.
Figure 8:
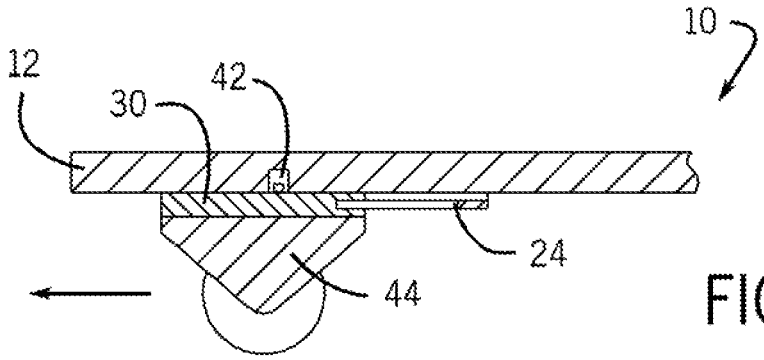
FIG. 8 is a cross-sectional view of the skateboard of FIG. 4 illustrating the disassembly of the truck and board.
Figure 9:
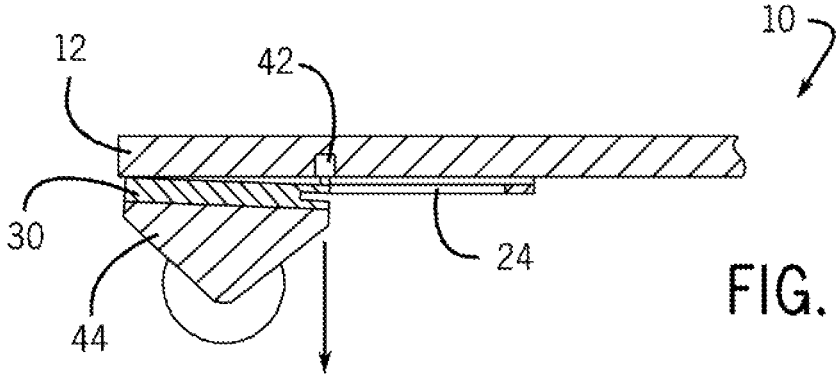
FIG. 9 is a cross-section view of the skateboard of FIG. 4 illustrating the disassembled truck and board.

To lock a truck shoe to a deck shoe, some embodiments may use a spring-loaded bullet catch 42 that may be disposed in the deck. For example, the truck shoe 30 can push down on the spring-loaded bullet catch located in front of the deck shoe assembly 24. After compressing the bullet catch 42 down, the deck shoe assembly 24 can be set flat against the deck and can slide backwards, e.g. 3¼", into the deck shoe assembly 24. The spring loaded bullet catch 42 can pop up into place locking the truck shoe 30 securely into the deck shoe assembly 24 once in place. The truck and wheel assembly 44 can be removed from the deck in the opposite 15 fashion as illustrated in FIG. 7-FIG. 9.

Figure 4:
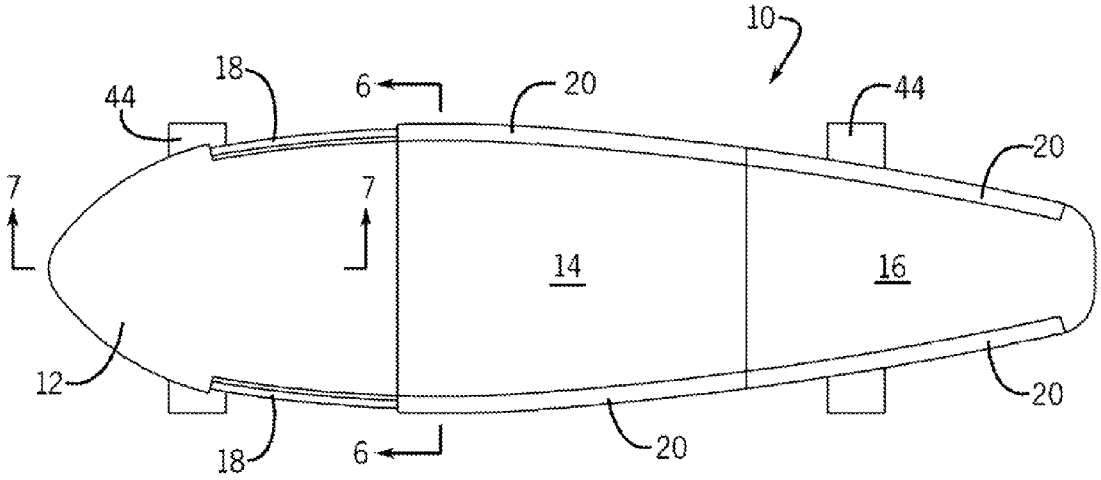
FIG. 4 is a top view of the skateboard of FIG. 1 illustrating a starting position of outer rails.
Figure 5:
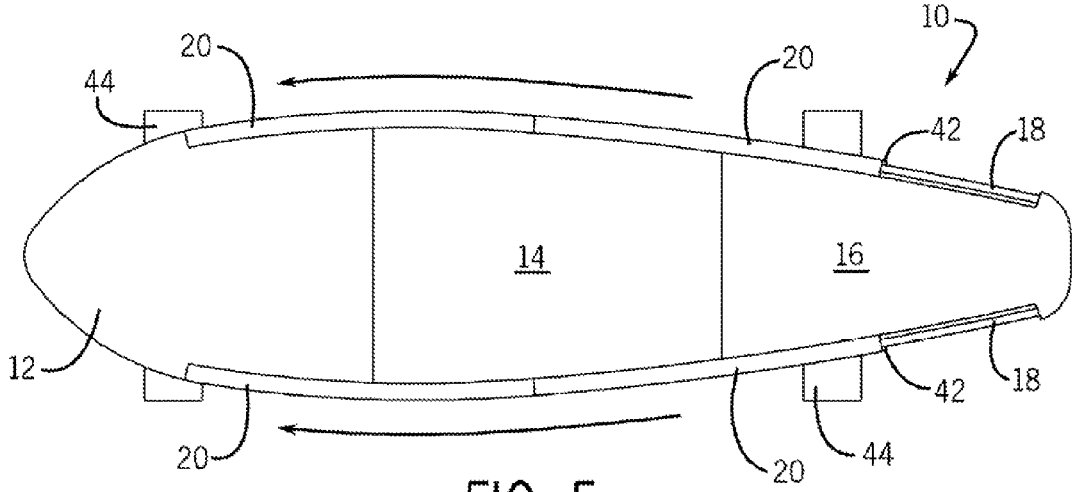
FIG. 5 is a top view of an assembled skateboard illustrating the rails in an assembled and locked position.
Figure 6:
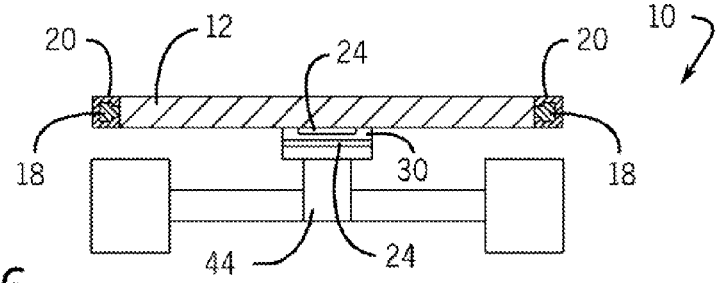
FIG. 6 is a cross-sectional view of the skateboard taken along the line 6-6 of FIG. 4.

The hinged Z-shaped deck can lock into a secure and rigid state in the following manner. As illustrated in FIG. 4 and FIG. 5, inner-rails 18 may be placed along the outside edges of the board pieces 12, 14, and 16 that may measure about ⅝" wide and ⅜" thick. The inner-rails 18 may be made from aluminum in some embodiments. A shallow channel, e.g., 1/16" deep and ⅛" wide may be formed along these inner-rails 18, which can be screwed in place. Two pairs of outer-rails 20 can be mounted onto the inner-rails 18 of the middle 14 and rear 16 board pieces. These outer-rails 20 can be made from 112" steel square tubing with an inside 25 diameter of ⅜", for example. Along one side of the entire length of the outer-rail 20, a ¼" wide slot may be cut to create a C-shaped cross section that can enable the outer-rails 20 to slide smoothly over the inner-rails 18.

With one hand holding the front board piece 12 and the other hand gripping the outer-rail 20 of the rear board piece 16, the Z-shaped folded deck can be quickly unfolded to a flat 45" deck. The hand gripping the rear outer-rail 20 can now slide forward which can simultaneously push the outer-rail 20 of the middle board piece 14 towards the front board piece 12 as illustrated in FIG. 5. The outer-rails 20 can travel about 7½" over the board pieces. The rear board piece's 16 outer-rail 20 can slide about 5 half-way over the inner-rail 18 of the middle board piece 14, and the outer-rail of the middle board piece 14 can slide about half-way over the inner-rail 18 of the front board piece 12. The moment the outer-rails 20 complete their travel, a spring-loaded bullet catch may pop out of the inner-rail 18, locking the two outer-rails 20 in place and forming a rigid flat longboard.

The flat longboard can be folded back to the Z-shaped tri-fold unit by reversing the folding operation. When the outer-rails 20 are in position to allow the board 10 to fold, a set of four bullet catches (not illustrated) may be used to hold the outer-rails 20 in place so they do not fall off when the board is in a folded configuration. For example, small dimples may be formed inside the outer rail that may be drilled deep enough for the heads of spring-loaded bullet catches to be secure, but shallow enough to allow the outer-rails 20 to be pushed forward with a firm grip of the outer-rail 20.

Figure 10:
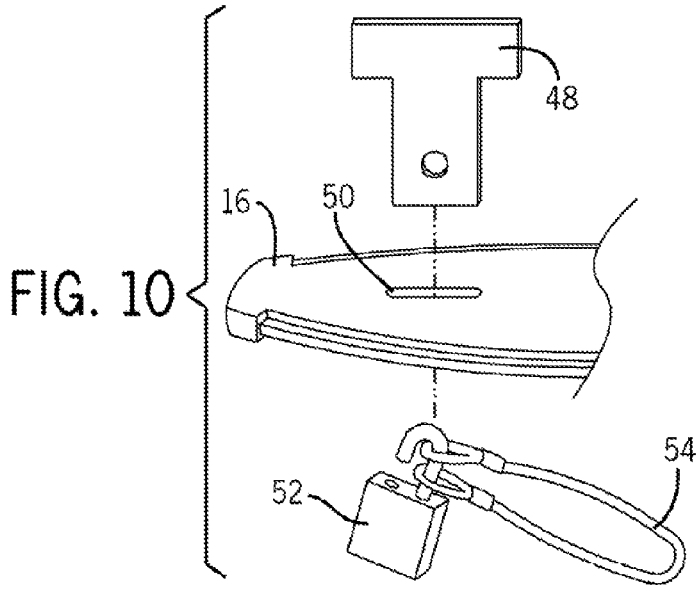
FIG. 10 illustrates one embodiment of a locking system for the skateboard.
Figure 11:
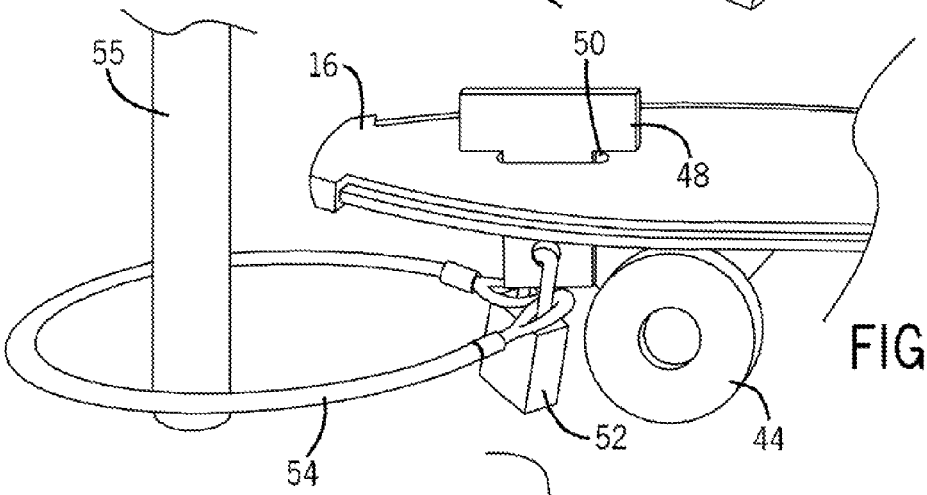
FIG. 11 illustrates use of the locking system illustrated in FIG. 10.
Figure 12:
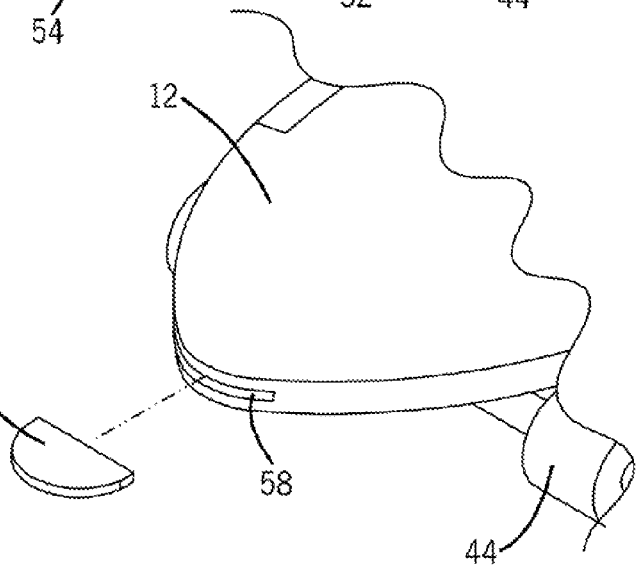
FIG. 12 illustrates a perspective view of one embodiment of a front bumper for a skateboard.
Figure 13:
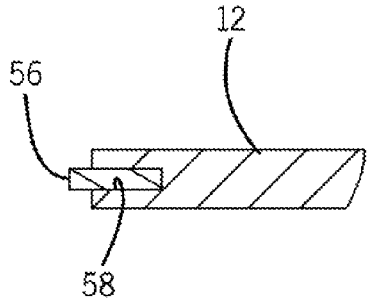
FIG. 13 is a cross-sectional view of the front bumper shown in FIG. 12.

As illustrated in FIG. 10-FIG. 11, some embodiments of the folding skateboard 10 may also include a key slot 50 in the rear board piece 16 to enable securing the skateboard to a post 55, for example. The key slot 50 may be used with a locking key 48 and a padlock 52 and lock cable 54 to lock the board to a post 55. Moreover, as illustrated in FIG. 12 some embodiments of the folding skateboard 10 may also include a bumper slot 58 in the front board piece 12 that may accommodate a bumper 56 to protect the nose of the folding skateboard 10. A cross sectional view of an installed bumper 56 is illustrated in FIG. 13.

Some embodiments of the folding skateboard 10 of the present invention may be made with a table saw, a drill press, and a router. Aluminum can be easily cut with metal cutting blades, drills, and router bits.

The wheel-truck plates can be made with an aluminum cutting router blade, following a wooden jig pattern made to the proper specification. A computer numerical control (CNC) cutting machine can be used to cut the ¼" grooves in the stainless steel outer-rails. The board can initially be made in one solid 9"×45" piece, shaped to a familiar skateboard outline, and then cut on table saw into 3 equal 15" lengths.

Figure 17:
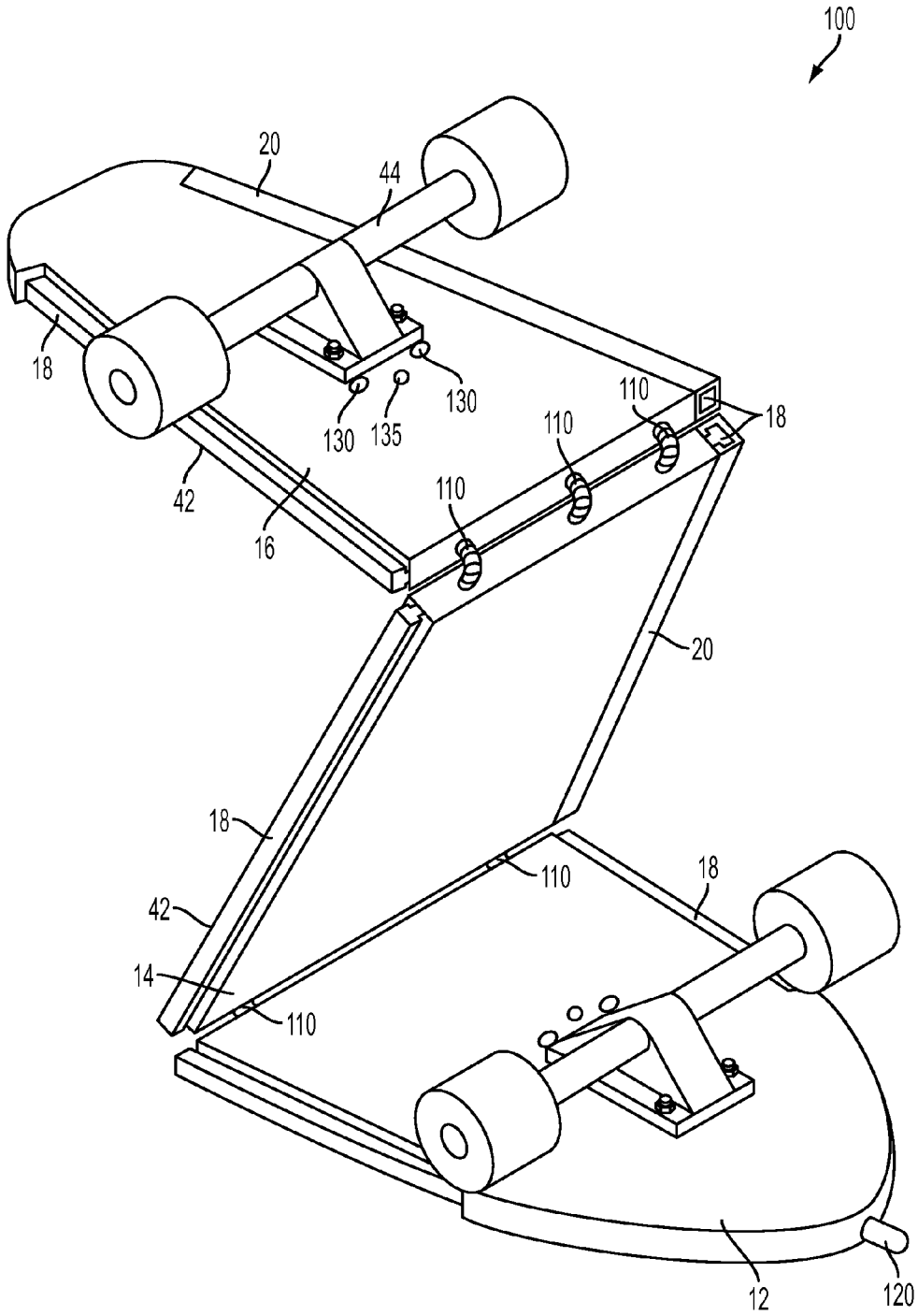
FIG. 17 is a perspective side view of a folding skateboard being folded according to another exemplary embodiment of the present invention.

Referring now to FIG. 17, a folding skateboard 100 is shown in accordance with an exemplary embodiment of the present invention. The folding skateboard 100 is similar to the folding skateboard 10 except that instead of using invisible hinges 22, the folding skateboard 100 may include spring 110 configured as a type of hinged mechanism. The springs 110 may connect the front board piece 12 to the middle board piece 14 and the middle board piece 14 to the rear board piece 16. The springs 110 may be inserted into dowel holes (not shown) aligned between respective board pieces 12, 14, and 16. By including springs 110 as a hinge mechanism, the board pieces 12, 14, and 16 may folded into the compact Z-shape when desired for stowing. In addition, the springs 110 may add less weight to the folding skateboard 100 when compared to invisible hinges and may be easier to disassemble if necessary.

Figure 18:
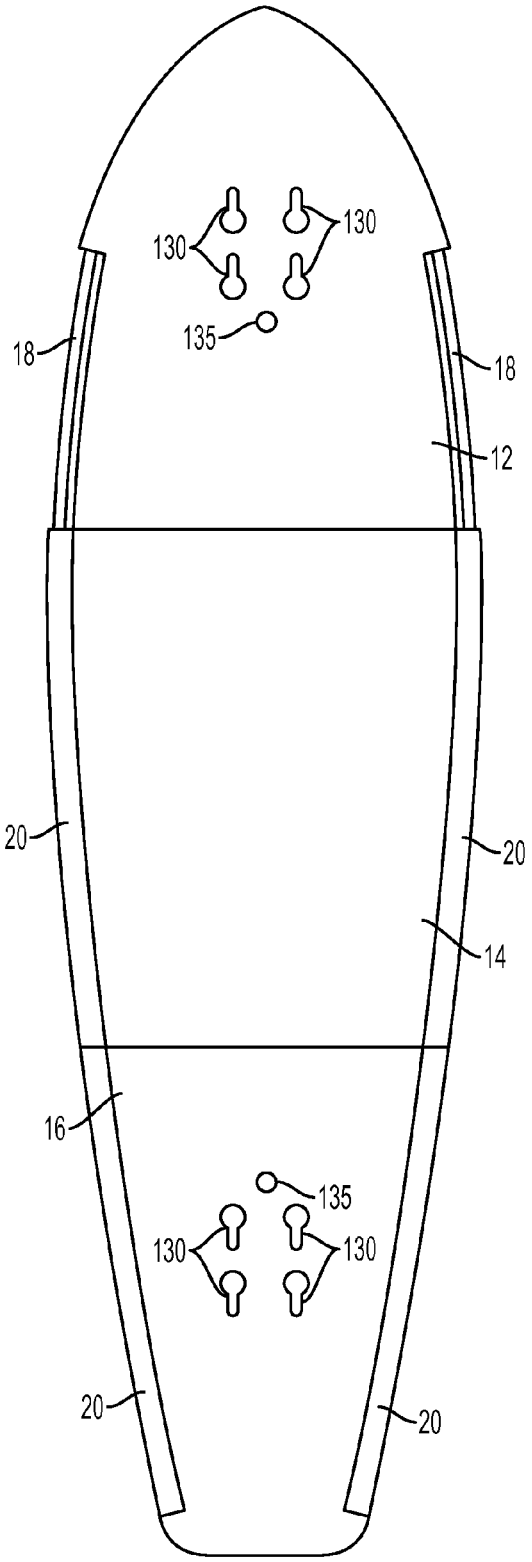
FIG. 18 is a bottom view of a skateboard deck of the folding skateboard of FIG. 17 without wheel assemblies.
Figure 19:
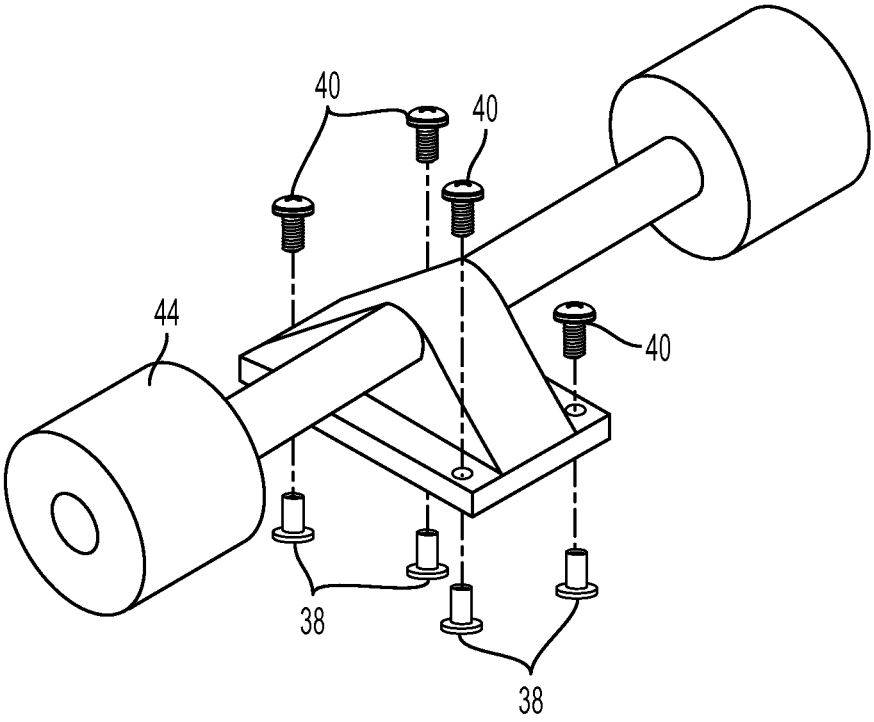
FIG. 19 is a top exploded view of a wheel assembly of the folding skateboard of FIG. 17.
Figure 19A:
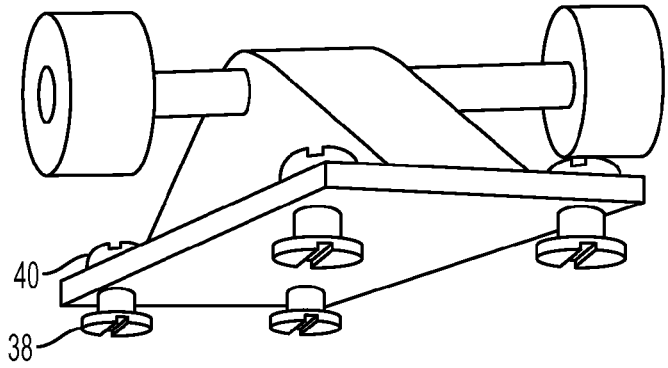
FIG. 19A is a bottom assembled view of the wheel assembly of FIG. 19.
Figure 19B:
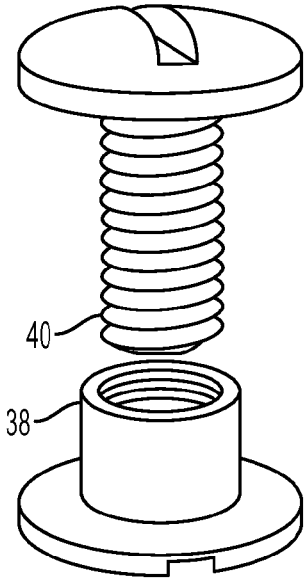
FIG. 19B is a side assembled view of an exemplary fastener assembly used in the wheel assembly of FIG. 19.

Referring now to FIGS. 18, 19, 19A, 19B, and 20, an exemplary embodiment of the folding skateboard 100 may provide readily removable truck and wheel assemblies 44 (FIG. 19). Referring to FIG. 18, the front and rear board pieces 12 and 16 may include key slots 130. The key slots 130 may be configured to receive fasteners, for example Chicago screws (male component 38 and female component 40) (FIGS. 19, 19A, 19B, and 20) that may plug into and slide into the key slots 130 and lock the truck and wheel assemblies 44 onto respective front and rear board pieces 12 and 16. The key slots 130 may allow the user to quickly slide the truck and wheel assemblies 44 off of the front and rear board pieces 12 and 16 when folding the folding skateboard 100 into the compacted Z-shape.

Figure 20:
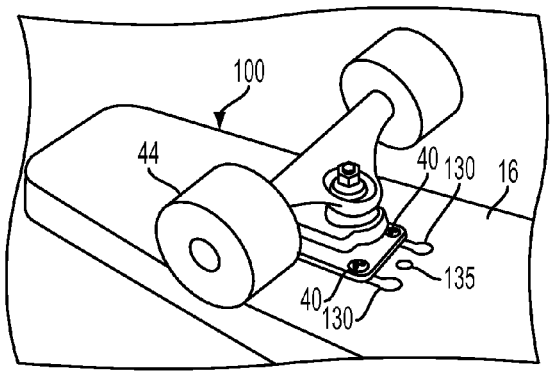
FIG. 20 is a perspective side view of the wheel assembly of FIG. 19 mounted onto the skateboard deck of FIG. 18.

Referring now to FIGS. 17, 18, and 20, the front and rear board pieces 12 and 16 may include respectively an anchor hole 135. The anchor holes 135 may be aligned along a lengthwise medial axis of the folding skateboard 100. The anchor holes 135 may be positioned between the truck and wheel assemblies 44.

Figure 22:
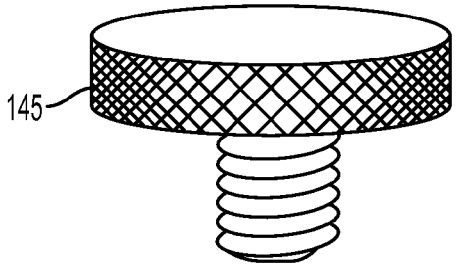
FIG. 22 is a side view of an exemplary fastener used to anchor a support in the skateboard shown in FIG. 21.
Figure 21:
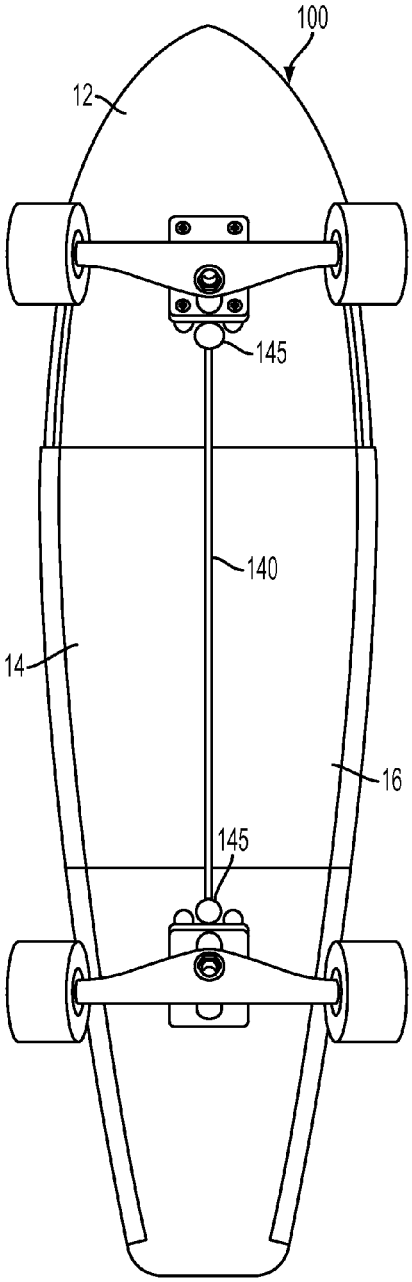
FIG. 21 is a bottom view of the folding skateboard of FIG. 17.

Referring concurrently now to FIGS. 18, 21, and 22, a support 140 may be mounted into the anchor holes 135 via fasteners 145. The fastener 145 may be for example, a knurled thumb screw. The support 140 may be for example a braided wire that may easily be coiled up when the folding skateboard 100 is folded and stowed. The support 140 may extend along the bottom side of the folding skateboard 100 between the truck and wheel assemblies 44. The support 140 provides an axial tension along the length of the deck pulling the front board piece 12 and the rear board piece 16 to the middle board piece 14. Thus, the support 140 may provide a counter force to the springs 110 (FIG. 17) tightly holding the front, middle and rear board pieces 12, 14, and 16 together. The support 140 may bear opposing weight against the front, middle and rear board pieces 12, 14, and 16 when the folding skateboard is in an extended position. Thus, as a user rides the folding skateboard 100, the support 140 may prevent the weight of the user from splitting apart the front, middle and rear board pieces 12, 14, and 16 at the spring hinges 110 (FIG. 17). In some embodiments, the fastener 145 may serve as a locking mechanism securely holding the truck and wheel assemblies 44 into place.

Referring back to FIG. 17, the folding skateboard 100 may also include a bumper 120. The bumper 120 may be a flexible projection protruding, for example, from a front or rear of the folding skateboard 100. The bumper 120 may be removable so that it can be stored when the folding skateboard 100 is folded and stowed.

It should be understood, of course, that the foregoing relates to exemplary embodiments of the invention and that modifications may be made without departing from the spirit and scope of the invention as set forth in the following claims.

What is claimed is:

1. A skateboard comprising:

a board deck comprising a first board piece, a second board piece, and a third board piece;

a first spring hinge connecting the first board piece to the second board piece; and a second spring hinge connecting the second board piece to the third board piece, wherein, when in a folded position, the first board piece, the second board piece and the third board piece, are configured to form a hinged three-layered configuration with the second board piece disposed between the first board piece and the third board piece.

2. The skateboard of claim 1, further comprising a first truck and wheel assembly on the first board piece and a second truck and wheel assembly on the third board piece.

3. The skateboard of claim 1, further comprising a support extending lengthwise along a bottom side of the first board piece, the second board piece and the third board piece.

4. The skateboard of claim 1, wherein the support is a wire.

5. The skateboard of claim 4, wherein the wire extends between the first and second truck and wheel assemblies.

6. The skateboard of claim 1, further comprising a bumper protruding from one of either the first board piece or the third board piece.

7. A skateboard comprising:

a board deck comprising a first board piece, a second board piece, and a third board piece;

a first spring hinge connecting the first board piece to the second board piece;

a second spring hinge connecting the second board piece to the third board piece, a key slot on the first board piece; and a truck, wherein the truck is mountable to the first board piece via a fastener configured to slide into the key slot and lock the truck onto the first board piece, and, wherein, when in a folded position, the first board piece, the second board piece and the third board piece, are configured to form a hinged three-layered configuration with the second board piece disposed between the first board piece and the third board piece.

8. The skateboard of claim 7, further comprising a braided wire attached to the first board piece and the third board piece and extending lengthwise between the first board piece and the third board piece.

9. The skateboard of claim 7, further comprising a removable bumper attached to either the first board piece or the third board piece.

* * * * *